US005600920A

United States Patent [19]

Roy

[11] Patent Number: 5,600,920

[45] Date of Patent: Feb. 11, 1997

[54] MOTORIZED LOUVER BLIND STRUCTURE IN A DOUBLE GLAZED WINDOW UNIT AND METHOD OF ASSEMBLING THE BLIND STRUCTURE

[75] Inventor: Fernand Roy, Brossard, Canada

[73] Assignee: UNICEL Inc., Boucherville, Canada

[21] Appl. No.: 556,649

[22] Filed: Nov. 13, 1995

[51] Int. Cl.[6] ..... E06B 7/08

[52] U.S. Cl. ..... 49/64; 49/506; 160/107

[58] Field of Search ..... 499/64, 82.1, 506; 160/107

[56] References Cited

U.S. PATENT DOCUMENTS

| | | | |
|---|---|---|---|
| 3,702,040 | 11/1972 | Roy | 49/64 |
| 4,427,048 | 1/1984 | Osaka et al. | 49/64 X |
| 4,505,069 | 3/1985 | Freeman | 49/64 |
| 4,586,289 | 5/1986 | Jaeger | 49/64 |
| 4,702,296 | 10/1987 | Anderson | 49/64 X |
| 4,979,552 | 12/1990 | Van Der Zanden | 160/107 |
| 5,396,944 | 3/1995 | Rossini | 160/107 |

*Primary Examiner*—Philip C. Kannan
*Attorney, Agent, or Firm*—François Martineau

[57] ABSTRACT

The window unit of the invention comprises four peripheral channel members linked with corner members to form a window frame. Two glass panels are spaced by this frame to form an inner chamber, the louver blind structure of the invention being located completely therein. The louver blind structure comprises a plurality of horizontal slats pivotally supported at both their extremities and each having an integral toothed wheel engaging a complementary rack on an actuator bar, the latter positioned adjacent to a side peripheral channel member and being free to move upwards or downwards along it. This upward or downward movement imparts a pivoting movement to the slats. The louver blind structure further comprises a support channel member supporting a reversible electrical motor having a driving shaft. This shaft has an eccentric stud which engages the actuator bar and must therefore be kept properly alined so as to resist radial forces exerted thereon. When the driving shaft rotates, it imparts a linear upward or downward movement to the actuator bar, thus pivoting the slats consequently. The alignment of the shaft is done by means of an L-shaped plate bored and threadingly engaged by an alignment sleeve, the latter being coaxially engaged by the driving shaft and disposed adjacent the actuator bar. This alignment of the shaft reduces the chances of breaking the actuating parts of the louver blind structure.

13 Claims, 3 Drawing Sheets

MOTORIZED LOUVER BLIND STRUCTURE IN A DOUBLE GLAZED WINDOW UNIT AND METHOD OF ASSEMBLING THE BLIND STRUCTURE

FIELD OF THE INVENTION

The present invention relates to a material louver blind structure mounted within a double glazed sealed window unit.

BACKGROUND OF THE INVENTION

It is well known that a double glazed window is very advantageous for its efficient thermal insulation. This is a result of the two glass panels trapping an air layer therebetween. Of course, it is necessary that the double glazed window unit be thoroughly sealed, else said unit would lose its particular insulating properties.

Louver blinds are often used with window structures for be positioned anywhere between a first and a second position that respectively allow most of the light to come through the window or block most of it, louver blinds being relatively aesthetic and inexpensive.

It is known in the art to incorporate a louver blind structure into a double glazed window unit, the slats of the louver blind being positioned between the two glass panels. The slats still allow an air layer to exist between the glass panels, and therefore the window unit does not lose its insulating properties, unless it is not properly sealed. One of the main advantages with this structure is that both slats and window form a single integral structure, and consequently simplifies the handling of the structure.

U.S. Pat. No. 3,702,040 issued in 1972 to the applicant Fernand ROY (hereafter the '040 patent) shows a typical louver blind structure for a double glazed sealed window unit. The window unit 1 comprises a peripheral frame 3, 4 spacing the glass panels 2 in a parallel relationship and a plurality of stud shafts 10, 11, axially aligned in pairs, that are engaged by and support the slats 9 in a parallel fashion. On one side of the window unit, inside the frame, the stud shafts have an enlarged diameter 19 and have outwardly protruding pins 20 that are inserted into complementary openings 21 inside an elongated vertical actuator bar 22. If actuator bar 22 is lifted or lowered, it will rotate pins 20 which will cause the reciprocating movement of stud shafts 10, 11 and slats 9. This will allow the user to position slats 9 as desired, i.e. anywhere between a closed overlapping position wherein the louver blind structure blocks most of the light and an opened spaced position wherein the louver blind structure allows most of the light to pass through. An outer gear wheel 42 allows an operator to lift or lower the actuator bar, and thus to simultaneously pivot the slats at the desired angle.

There are three main problems related to such structures. The first problem is that the drive mechanism, e.g. manually actuated wheel 42 in the '040 patent, is positioned outside the window unit. It therefore requires space to be installed around the window, e.g. a hole fitted in the wall adjacent to the window for the casing of the wheel. This is not desirable, since the conventional window openings cannot be used without modifications to accommodate such a window and louver blind assembly, complicating the installation of the assembly significantly. The second problem is that, due to the moving parts that link the drive mechanism with the actuating mechanism, it is difficult if not impossible to perfectly seal the window unit. The double glazed window unit therefore loses a fraction of its efficiency because of this leak in its insulation. The third problem is related to the fact that it is very complicated to reach the louver blind structure once the window unit is sealed and installed. However, the problem only comes up if it is necessary to reach the louver blind structure: some parts, such as moving parts, are prone to breaking, and in the known art, these moving parts are not installed very securely. Indeed, the driving shaft, linking the power means (the manually operated gear wheels 40 to 42 in the '040 patent) to the actuating means (the actuator bar 22 in the '040 patent), will be prone to loosen its engagement with the actuating means since it is supported at its two extremities by two moving parts, namely the power means and the actuator means. If there is to be a problem with the louver blind structure, it becomes very expensive to repair them.

OBJECTS OF THE INVENTION

It is the main object of this invention to provide a louver blind structure incorporated in a double glazed sealed window unit, wherein the drive mechanism is motorized and is entirely located inside the frame of the window structure so as to provide an integral unit of standard shape.

SUMMARY OF THE INVENTION

The present invention relates to a louver blind structure in combination with a multiple glazed window unit, said window unit comprising:

a) two spaced-apart glass panels; and b) a window frame spacing said glass panels, comprising a number of peripheral elongated members and linked two by two at the corners of said window frame; said window unit defining an inner chamber between said glass panels and inside said window frame, said louver blind structure being positioned within said inner chamber and comprising:

a) a plurality of parallel and pivotable slat members;

b) reversible power means secured to said window frame and having a driving shaft parallel to and near one of said window frame peripheral channel members;

c) actuating means linking said power means driving shaft to said slat members, causing a reversible pivoting movement of said slat members upon powering of said power means; and d) an alignment member for correctly and securely positioning said power means driving shaft relative to said actuating means, said alignment member located adjacent to said actuating means and anchored to said window frame.

Preferably, said peripheral members are channel members linked two by two by corner members and the window frame further comprises an elongated support channel member spacedly positioned in a generally parallel fashion near one of said window frame peripheral channel members, said power means resting on said support channel member and said alignment member being anchored thereto.

Preferably, said support channel member defines a female end engageable by said alignment member.

Advantageously, said louver blind structure comprises an alignment sleeve and said alignment member defines a first and a second leg and a bore through said second leg, said female end of said support channel member being engaged by said alignment member first leg, said actuating means including a pair of rail members fixed to one of said window frame peripheral channel members and an actuator bar guided by said rail members for reciprocating linear movement said second leg abutting against said rail members, being fixedly anchored thereto and being fixedly engaged by said alignment sleeve through said bore, said power means driving shaft being axially inserted in said alignment sleeve to be supported and correctly aligned therein and to axially rotate freely therein.

Advantageously, each of said slats defines a pivoting axis, two extremities and at least one integral pivot shaft coaxial to its pivoting axis and positioned at one extremity of said slat, said actuator bar having a plurality of spaced transverse openings respectively engaged by said slat member pivot shafts and comprising carrying means for imparting a simultaneous pivoting movement to said pivot shafts when said actuator bar moves in said linear movement, said alignment member second leg abutting against said rail member without hindering the linear movement of said actuator bar, rotation of said driving shaft producing said reciprocating movement to said actuator bar.

Preferably, said alignment member is L-shaped, said first leg and said second leg thus being perpendicular to one another.

Advantageously, said louver blind structure comprises a blocking collar axially and fixedly engaging said power means driving shaft and slidably abutting against said alignment sleeve.

Advantageously, said peripheral channel members and said support channel member have a similar and constant cross-section.

The invention also relates to a method of assembling a louver blind structure inside a double glazed window unit, said window unit of the type comprising two glass panels, a number of peripheral elongated channel members and an equal number of corner members, said louver blind structure comprising a plurality of slat members having pivot shafts, an elongated support channel member, a driving shaft, power means, actuating means including a rail member and an actuator bar movable along said rail member, an alignment member defining a first and a second leg and a bore through said second leg, and an alignment sleeve, said method comprising the following steps:

a) attaching said rail member along at least one of said peripheral channel members;

b) pivotally engaging said actuating bar with said slat member pivot shafts;

c) abutting said second leg of said alignment member against said rail member and fixing it thereto;

d) engaging said driving shaft in said actuating bar, through said bore of said alignment member second leg;

e) axially engaging said alignment sleeve around said driving shaft;

f) fixing said alignment sleeve in said alignment member second leg bore, for axially and radially positioning said driving shaft relative to said alignment member and said actuating means;

g) engaging said alignment member first leg in said support channel member and fixing it thereto;

h) connecting said power means to said driving shaft; and i) fixing said power means to said support channel member.

Preferably, said louver blind structure comprises a blocking collar, said method further comprising the following step between steps f) and g): engaging said blocking collar around said driving shaft, abutting it against said alignment sleeve and securely fixing it to said driving shaft.

DETAILED DESCRIPTION OF THE EMBODIMENTS

Figure 1:
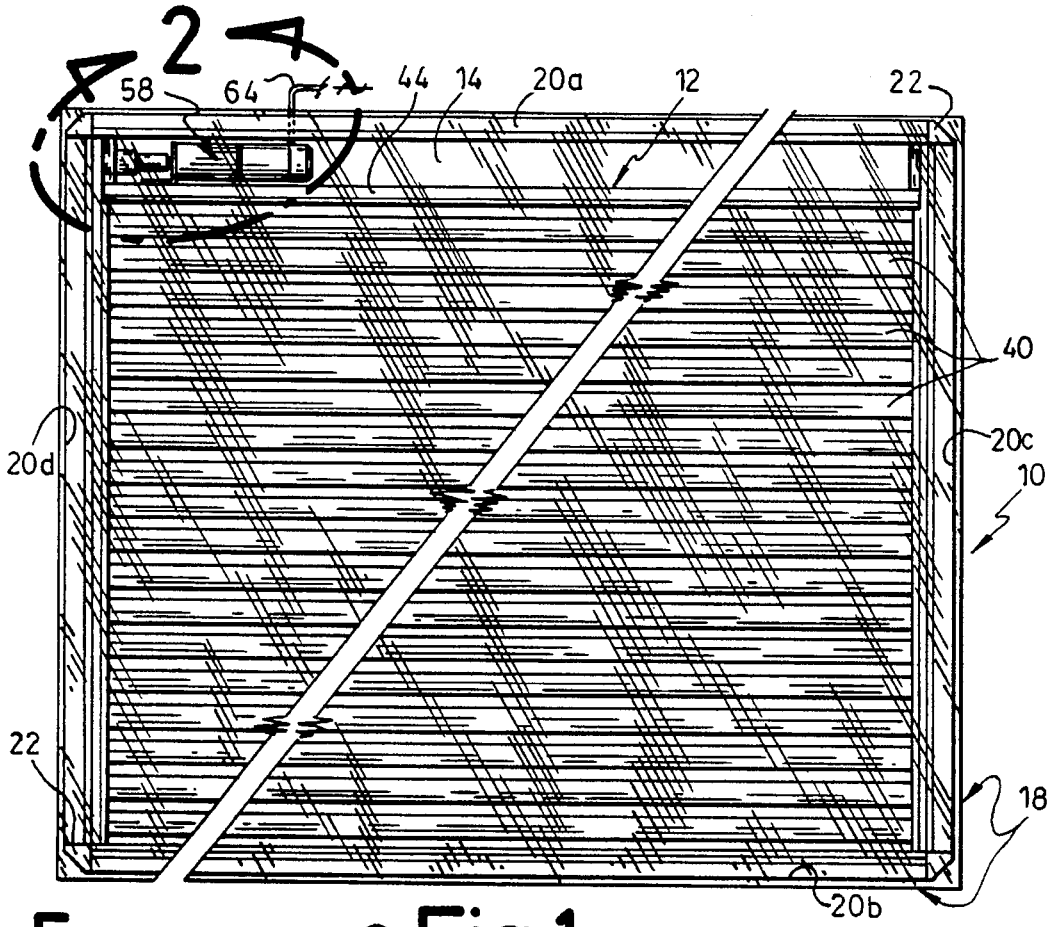
FIG. 1 is an elevation of a double glazed sealed window unit with a louver blind structure according to the invention.
Figure 2:
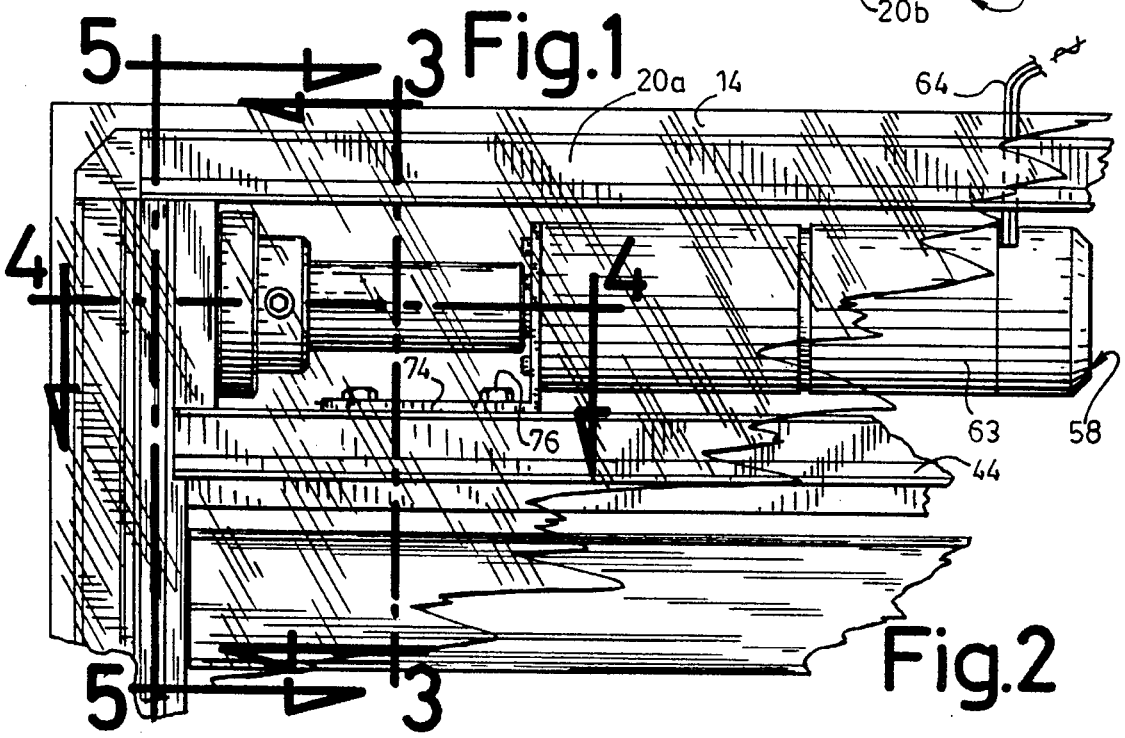
FIG. 2 is an elevation, at an enlarged scale, of the area circumscribed in line 2 of FIG. 1.

FIG. 1 shows a double glazed window unit 10 in which is incorporated a louver blind structure 12.

Figure 7:
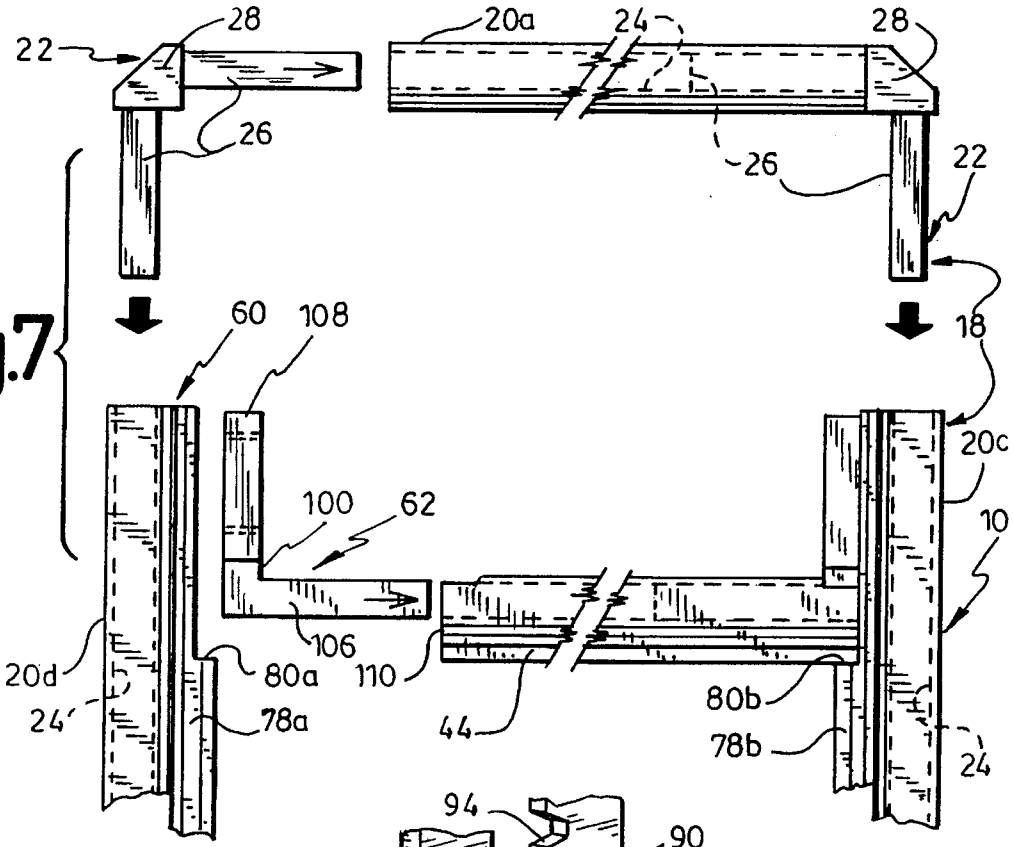
FIG. 7 is an exploded view of the frame structure of the double glazed sealed window unit.

Window unit 10 comprises two spaced-apart glass panels 14, 16 (FIGS. 3 and 4) and a rectangular window frame 18 (FIGS. 1 and 7). FIGS. 1 and 7 show that window frame 18 comprises four elongated peripheral channel members 20 (20*a* to 20*d*) linked in an alternate fashion by means of four L-shaped corner members 22 that slidingly engage the inner channels 24 of peripheral channel members 20. Corner members 22 each define a pair of legs 26 integrally attached to an abutment plate 28 which is wider than legs 26. It is thus the male legs 26 that engage the female inner channels 24 of channel members 20, the latter abutting on abutment plate 28 to provide a continuous, closed window frame 18. Frame 18 spaces glass panels 14, 16 which are fixed onto it, as is known in the art, in a parallel fashion. An inner chamber is thus defined by the area marked by window frame 18 and glass panels 14, 16.

Figure 3:
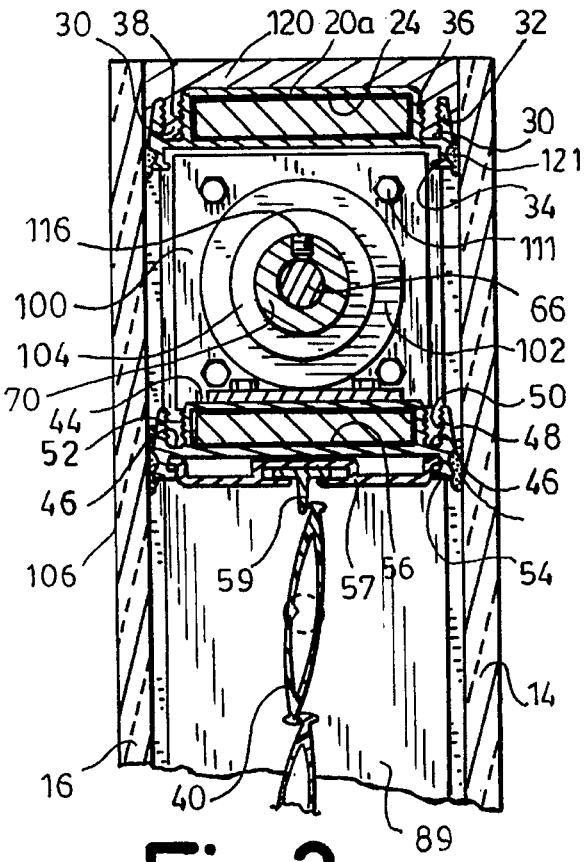
FIG. 3 is a cross-sectional view taken along line 3—3 of FIG. 2.

FIG. 3 shows that the cross-section of each peripheral channel member has a pair of longitudinal outwardly-extending webs 30, each defining an upwardly-extending flange 32 and a downwardly-extending and inwardly-oriented lip 34. Upward flange 32 is longitudinally grooved on its inner surface 36, as is peripheral channel member 20 on both its outer narrow sides at 38, the grooved surfaces 36, 38 thus facing each other.

Figure 6:
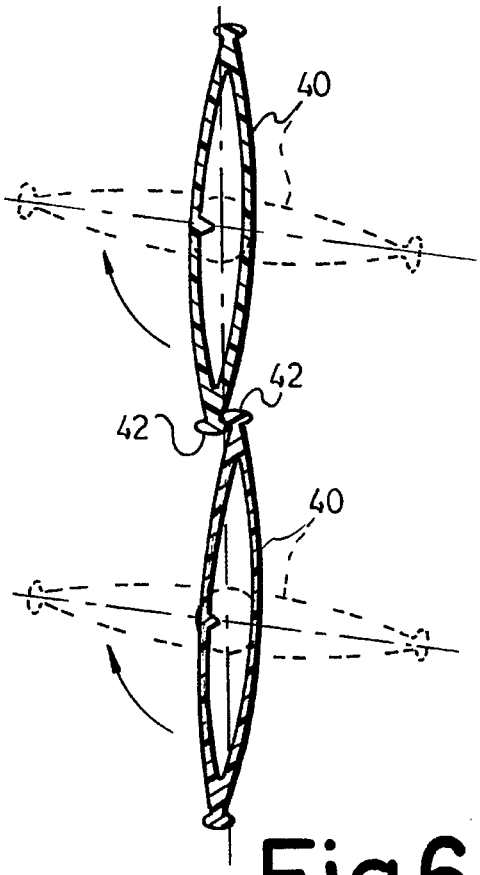
FIG. 6 is a cross-sectional view of two slat members, showing their common pivoting relationship.

FIG. 1 shows that louver blind structure 12 is located inside the inner chamber of window unit 10 and comprises a plurality of known louver members or slat members 40 which are equally spaced and horizontally disposed. As shown in FIG. 6, slat members 40 can pivot from a first generally vertical position (shown in full lines) in which they slightly overlap one another so as to form a generally uniform vertical surface that may block almost completely the light streaming through the window, to a second generally horizontal position (shown in phantom lines) that will let the light pass almost completely through window unit 10. Each slat member 40 preferably defines small edgewise inter-connectable abutment members 42 at their top and bottom edges that can each hook themselves with the abutment member 42 of the upwardly and downwardly adjacent slat members 40 for a better overlapping relation of slat members 40. Each slat member 40 defines a first and a second extremity and has at least one pivot shaft (not shown) at its first extremity coaxial with its pivoting axis; in the case of horizontal slat members, such as is illustrated in FIGS. 1 to 8, slat members 40 also has a second pivot shaft at its second extremity, axially aligned with the first pivot shaft.

FIG. 3 shows that louver blind structure 12 further comprises a channel member 44 that is similar, if not 5 almost identical, to peripheral channel members 20. Indeed, the cross-section of support channel member 44 defines a pair of longitudinal outwardly-extending webs 46, each having upwardly-extending flanges 48, grooved at their inner surfaces 50 to face the grooved outer narrow sides 52 of support channel member 44, and a downwardly-extending and inwardly-oriented lip 54. An inner channel 56 is located inside support channel member 44. The reason for these identical cross-sections is that both support channel member 44 and peripheral channel members 20 are made exactly the same way, but each are cut at a possibly different desired length. This allows to cut manufacturing costs significantly, since there does not have to be two different designs but only one, for two different parts of the window unit and louver blind assembly.

Support channel member 44 spans the whole width of the inner chamber of window unit 10 and it is spacedly positioned in a parallel fashion near the upper peripheral channel member 20*a* of window frame 18. An elongated strip 57, as shown in FIG. 3, has a snap fit with lips 54 of support channel member 44, a short, elongated, central downwardly extending flange 59 depending therefrom. The topmost slat member 40 will abut on and slightly overlap flange 59.

FIGS. 1 to 5 and 7, 8 show that louver blind structure 12 finally comprises power means 58, actuating means 60 and alignment means 62.

Power means 58 is preferably a small reversible electrical motor 63, connected to an electrical source (not shown) by a feeder cable 64. Power means 58 can be activated by means of a remote control or a switch.

Power means 58 further includes a small output shaft 66 powered by electrical motor 63 through a conventional speed reducer. Shaft 66 is inserted into the complementary coaxial bore 68 at the first end 70*a* of a driving shaft 70 and steadfastly fixed thereto with a pair of set screws 72, 72 so that shafts 66, 70 share the same rotation movement imparted by motor 63. Driving shaft 70 defines a second end 70*b* opposite first end 70*a*.

Motor 63 is mounted on a support 74 that rests on support channel member 44 and is fixed thereto by means of bolts 76, steadfastly holding motor 63 over support channel member 44.

Actuating means 60 comprises a known system similar to the one described in the '040 patent in the background of the invention. One rail member 78*a*, 78*b* (FIG. 7) is fixedly attached to each of the side peripheral channel members 20*c*, 20*d*. Indeed, rail members 78*a*, 78*b* define outward flanges 79 (FIG. 4) that are adapted to engage lips 34 in a snap fit relationship. Rail members 78*a*, 78*b* span the whole height of the inner chamber of window unit 10 and have a shoulder 80*a*, 80*b* (FIG. 7) for support channel member 44 to rest upon, the latter thus being supported at both its extremities.

Figure 4:
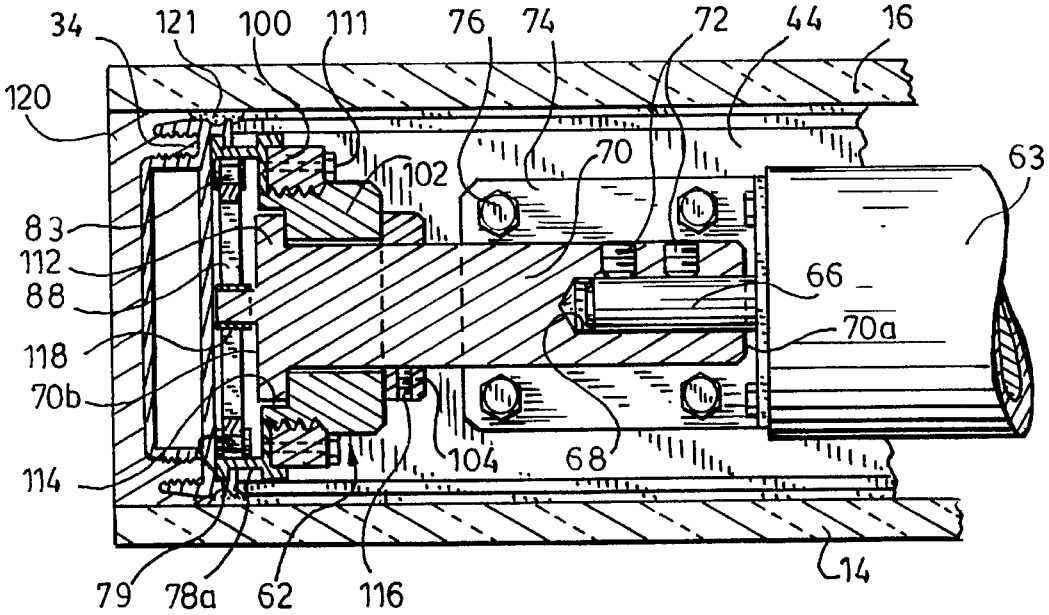
FIG. 4 is a cross-sectional view taken along line 4—4 of FIG. 2.
Figure 5:
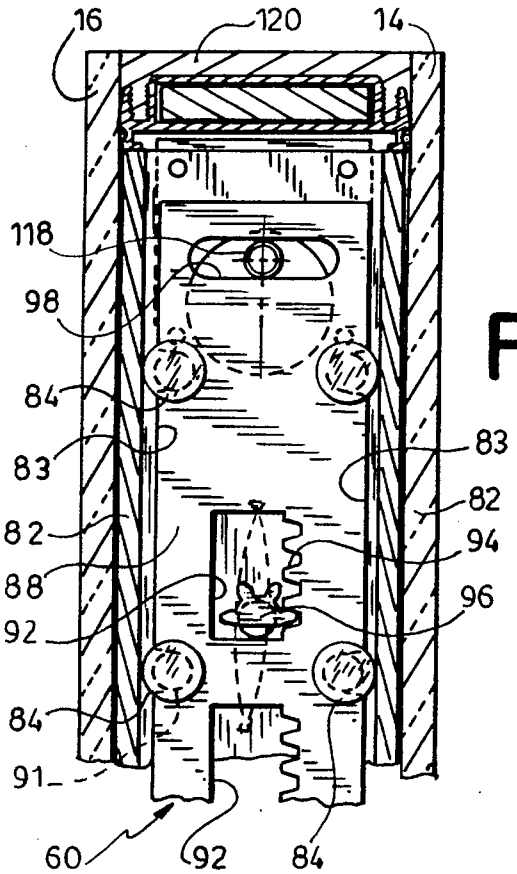
FIG. 5 is a cross-sectional view taken along line 5—5 of FIG. 2.

Each rail member 78*a*, 78*b*, e.g. rail member 78*a* seen in FIGS. 4 and 5, has a pair of rails 82 which define a plane surface 83 to be tangentially engaged by a plurality of idle wheels 84.

Actuating means 60 also comprises an actuator bar 88 positioned in one rail member, namely rail member 78*a*, movable between rails 82, being almost as long as rail member 78*a* and being positioned between peripheral channel member 20*d* and a cover plate 89 (FIG. 3). Actuator bar 88 has a plurality of spaced edgewise openings 90 on both of its edges (FIG. 8), openings 90 being correctly dimensioned and adapted to receive radial grooves 91 cut in idle wheels 84, the thickness of actuator bar 88 being equal or slightly smaller than the width of radial groove 91 so as to trap actuator bar 88 in grooves 91 of idle wheels 84.

In use, idle wheels 84 are positioned between rails 82 and actuator bar 88, which they engage in a rolling relationship, and can guide the movement of actuator bar 88 along rail member 78*a* in an upward or downward linear displacement.

Figure 8:
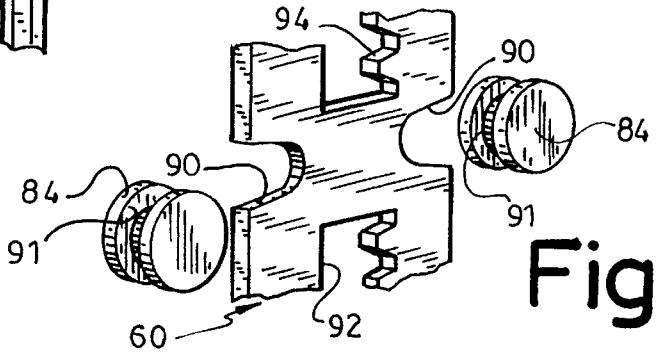
FIG. 8 is a partial exploded perspective view, at an enlarged scale, of the actuator bar and idle wheels of the invention.

FIGS. 5 and 8 show that actuator bar 88 has a plurality of equally spaced, transverse openings 92 in its intermediate portion. One such transverse opening 92 corresponds to each slat member 40. Carrying means link openings 92 to slat members 40, for imparting a pivoting movement to slat members 40 when actuator bar accomplishes a linear displacement. The carrying means can be, as shown in FIG. 5, an integral toothed rack 94 cut inside each opening 92 to be engaged by a complementary toothed wheel 96 integrally and coaxially fixed to said first pivot shaft of a corresponding slat member 40. Thus, when actuator bar 88 accomplishes a linear displacement, rack 94 imparts a rotation movement to wheel 96 and consequently pivots slat members 40. The length of opening 92 (and of rack 94) is correctly dimensioned to allow the slat members to pivot from their first vertical position to their second horizontal position. Slat members 40 are also sustained at their second extremity by their second pivot shaft, which pivotally engages a support member (not shown) in rail member 78*b*.

Actuator bar 88 further comprises a widthwise, transverse groove 98 (FIG. 5) at its upper end.

As shown in FIGS. 3 and 4, alignment means 62 comprises an alignment member 100, an alignment sleeve 102 and a blocking collar 104.

Alignment member 100 is a generally flat, L-shaped plate having a first and a second leg 106 and 108 (FIG. 7). Male first leg 106 is correctly dimensioned to engage channel 56 at the female end 110 of support channel member 44 and be secured thereto by means of bolts 76 that hold motor support 74 by passing through the upper surface of channel member 44 and first leg 106. Second leg 108 is fixedly anchored to rail member 78*a* (e.g. with bolts 111) and is bored and threaded in its bore to be threadingly engaged by alignment sleeve 102. Driving shaft 70 axially engages, near its second end 70*b*, alignment sleeve 102 and can freely rotate therein, though little or no radial displacement is possible. Driving shaft 70 defines a radial flange 112 at its second end 70*b* which abuts against a corresponding shoulder 114 on alignment sleeve 102. (FIG. 4). Blocking collar 104 axially abuts against alignment sleeve 102 and is secured on driving shaft 70 by means of a set screw 116. Therefore sleeve 102 and collar 104 prevent bi-directional axial movement of driving shaft 70.

The end of driving shaft 70 opposite motor 63 is flat and has a small eccentric rotatable stud 118 protruding therefrom. Stud 118 engages groove 98 of actuator bar 88.

Driving shaft 70 will thus be supported securely by alignment means 62 since the latter does not move and offers a steady support. Alignment member 100 and alignment sleeve 102 prevent any radial displacement of driving shaft 70, while the abutment of collar 104 on alignment sleeve 102 and the abutment of radial flange 112 on shoulder 114 will prevent any axial displacement of driving shaft 70. Therefore, driving shaft 70 will not be allowed to move in any direction, except for an axial rotation. Since actuator bar 88 is also prevented from any undesired movement by being guided in rail member 78*a*, the moving parts of louver blind structure 12 will likely not diverge from the field of positions they were intended to take.

It is an important advantage of this invention that alignment means 62 prevent driving shaft 70 from radially moving. It is very important that shaft 70 always stay aligned, for once window unit 10 is sealed and embedded into a wall, then repairing a faulty louver blind structure can become a very tedious and expensive job. Therefore, to align properly the different moving parts is very important, since these are the parts that are more prone to breaking. This is why driving shaft 70 is aligned through the instrumentality of alignment means 62 which are relatively resistant and precise.

Of course, the fit between alignment sleeve 102 and driving shaft 70 will probably not be perfect, i.e. there will be a small radial play between the two, but since shaft 70 is not destined to have a high rotation speed nor to be submitted to torques of important values, this play will not significantly hamper the movement of shaft 70.

In use, when motor 63 is powered, driving shaft 70 rotates through the instrumentality of output shaft 66 and stud 118 rotates around the rotation axis of driving shaft 70. Stud 118 can freely roll or slide sideways in groove 98 while its upward or downward movement will impart a same displacement to actuator bar 88. Thus, when driving shaft 70 rotates, actuator bar 88 moves upwards or downwards and consequently pivots slat members 40.

Since there are no moving parts other than those inside the inner chamber of window unit 10, the window can be completely sealed. A proper sealing material 120 (FIGS. 3 to 5) is used all around window unit 10, as is known in the art, being installed over the peripheral channel members 20. It is embedded between the teeth 36 and 38 of upward flange 32 and the narrow side of peripheral channel members 20, so that, once it is dry, it will be held in place by said teeth, sealing window unit 10 in an air-tight fashion. A sealant 121 seals glass panels 14, 16, lips 34 of members 20. Similarly a sealant 121*a* seals glass panels 14, 16 to lips 54 of support channel member 44. Therefore, the motor chamber is sealed from the main chamber containing slat members 40.

To assemble louver blind structure 12 inside window unit 10, a precise order must be followed step by step. The assembling of the louver blind structure must be done while the window unit is not yet assembled itself. The method generally comprises the following steps:

a) attaching the actuating means along at least one peripheral channel member;

b) pivotally engaging the actuating means with slat member pivot shafts;

c) abutting the second leg of the alignment member against the actuating means and fixing it thereto;

d) engaging the driving shaft in the actuating means, through the bore of the alignment member second leg;

e) axially engaging the alignment sleeve around the driving shaft;

f) fixing the alignment sleeve in the alignment member second leg bore, said sleeve serving to axially position the driving shaft relative to the alignment member and the actuating means;

g) engaging the alignment member first leg in the support channel member and fixing it thereto;

h) connecting the power means to the driving shaft; and i) fixing the power means to the support channel member.

Preferably, the following step is inserted between steps f) and g): engaging said blocking collar around said driving shaft, abutting it against said alignment sleeve and securely fixing it to said driving shaft.

It is understood that, although a conventional rectangular window unit has been disclosed in the present invention, any other shape may be suitable. For example, an hexagonal window unit could be used, the window frame then comprising six peripheral channel members and a like number of corner members, which will not be L-shaped but will form an obtuse angle. There would have to be two actuator bars linked to one another, one carrying the other under the movement of the driving shaft, and the radius of the toothed wheel or the pitch of the toothed wheel and rack would have to be modified on the carried actuator bar to compensate the displacement difference resulting from the angle between the two actuator bars.

Also, it would be possible to provide non-parallel window panels, by providing the desired angle to the sides of the channel members where the panels are fixed.

Moreover, within the scope of the invention, vertical slat members could be provided, only a single support shaft at their upper end then being necessary since the slat members would keep their vertical position by means of their own weight bearing them down. The actuator bar would of course be horizontal, at the top of the inner chamber of window unit 10.

It is also understood that the actuating means could be of another type than that of the character described. For example, it could be a long actuator rod instead of the actuator bar, and small metal rods eccentrically linked to the actuator rod instead of the rack and gear assembly.

I claim:

1. In combination, a multiple glazed window unit and a louver blind structure, said window unit comprising:

a) two spaced-apart glass panels; and b) a window frame spacing said glass panels, comprising a number of peripheral elongated members linked two by two at the corners of said window frame;

said window unit defining an inner chamber between said glass panels and inside said window frame, said louver blind structure, positioned within said inner chamber and comprising:

a) a plurality of parallel and pivotable slat members;

b) reversible power means having a driving shaft parallel to and near one of said window frame peripheral channel members;

c) actuating means linking said power means driving shaft to said slat members, causing a reversible pivoting movement of said slat members upon powering of said power means; and d) an alignment member for correctly and securely positioning said power means driving shaft relative to said actuating means, said alignment member being located adjacent said actuating means and anchored to said window frame.

2. The combination as defined in claim 1, wherein said window frame further includes an elongated support member spacedly positioned within said inner chamber in a generally parallel fashion near one of said window frame peripheral members, said power means resting on said support member and said alignment member being anchored thereto.

3. In combination, a louver blind structure and a doubled glazed window unit, said window unit comprising:

a) two spaced-apart glass panels; and b) a window frame spacing said glass panels, comprising a number of peripheral elongated channel members and an equal number of corner members, the latter being adapted and correctly dimensioned to engage said peripheral channel members in an anchoring fashion, each corner member linking two channel members, so as to close said window frame on all sides between said glass panels;

wherein said window unit defines an inner chamber between said glass panels and inside said window frame, said louver blind structure positioned inside said inner chamber and comprising:

a) a plurality of parallel and pivotable slat members;

b) reversible power means secured to said window frame and having a driving shaft parallel to and near one of said window frame peripheral channel members;

c) actuating means linking said power means driving shaft to said slat members, causing a reversible pivoting movement of said slat members upon powering of said power means; and d) an alignment member for correctly and securely positioning said power means driving shaft relative to said actuating means, said alignment member being located adjacent said actuating means and anchored to said window frame.

4. The combination as defined in claim 3, wherein said window frame further includes an elongated support channel member spacedly positioned in a generally parallel fashion near one of said window frame peripheral channel members, said power means resting on said support channel member and said alignment member being anchored thereto.

5. The combination as defined in claim 4, wherein said support channel member defines a female end engaged by said alignment member.

6. The combination as defined in claim 5, wherein said louver blind structure comprises alignment sleeve and said alignment member defines a first and a second leg and a bore through said second leg, said female end of said support channel member being engaged by said alignment member first leg, said actuating means including a pair of rail members fixed to one of said window frame peripheral channel members and an actuator bar guided by said rail members for reciprocating linear movement, said second leg abutting against said rail members, being fixedly anchored thereto and being fixedly engaged by said alignment sleeve through said bore, said power means driving shaft being axially inserted in said alignment sleeve to be supported and correctly aligned therein and to axially rotate freely therein.

7. The combination as defined in claim 6, wherein each of said slats defines a pivoting axis, two extremities and at least one integral pivot shaft coaxial to its pivoting axis and positioned at one extremity of said slat, said actuator bar having a plurality of spaced transverse openings respectively engaged by said slat member pivot shafts and comprising carrying means for imparting a simultaneous pivoting movement to said pivot shafts when said actuator bar moves in said linear said alignment member second leg abutting against said rail members without hindering the linear movement of said actuator bar, rotation said driving shaft producing said reciprocating linear movement of said actuator bar.

8. The combination as defined in claim 7, wherein said alignment member is L-shaped, said first leg and said second leg thus being perpendicular to each other.

9. The combination as defined in claim 8, wherein said louver blind structure comprises a blocking collar axially and fixedly engaging said power means driving shaft and slidably abutting against said alignment sleeve.

10. The combination as defined in claim 6, wherein said louver blind structure comprises a blocking collar axially and fixedly engaging said power means driving shaft and slidably abutting against said alignment sleeve.

11. The combination as defined in claim 5, wherein said peripheral channel members and said support channel member have a similar and constant cross-section.

12. A method of assembling a louver blind structure inside a doubled glazed window unit, said window unit of the type comprising two glass panels, a number of peripheral elongated channel members and an equal number of corner members, said louver blind structure comprising a plurality of slat members having pivot shafts, an elongated support channel member, a driving shaft, power means, actuating means including a rail member and an actuator bar movable along said rail member, an alignment member defining a first and a second leg and a bore through said second leg, and an alignment sleeve, said method comprising the following steps:

a) attaching said rail member along at least one of said peripheral channel members;

b) pivotally engaging said actuating bar with said slat member pivot shafts;

c) abutting said second leg of said alignment member against said rail member and fixing it thereto;

d) engaging said driving shaft in said actuating bar, through said bore of said alignment member second leg;

e) axially engaging said alignment sleeve around said driving shaft;

f) fixing said alignment sleeve in said alignment member second leg bore, for axially and radially positioning said driving shaft relative to said alignment member and said actuating means;

g) engaging said alignment member first leg in said support channel member and fixing it thereto;

h) connecting said power means to said driving shaft; and i) fixing said power means to said support channel member.

13. A method as defined in claim 12, wherein said louver blind structure comprises a blocking collar, said method further comprising the following step between steps f) and g): engaging said blocking collar around said driving shaft, abutting it against said alignment sleeve and securely fixing it to said driving shaft.

* * * * *